US006579089B1

(12) United States Patent
Iu

(10) Patent No.: US 6,579,089 B1
(45) Date of Patent: Jun. 17, 2003

(54) FLOATING CANDLE HOLDER

(76) Inventor: Stephen Iu, Candoil, Inc. d/b/a Windflo 1909 Skillman, Dallas, TX (US) 75206

( * ) Notice: Subject to any disclaimer, the term of this patent is extended or adjusted under 35 U.S.C. 154(b) by 35 days.

(21) Appl. No.: 09/894,253

(22) Filed: Jun. 28, 2001

(51) Int. Cl.[7] ..... F21V 35/00
(52) U.S. Cl. ..... 431/291; 220/560
(58) Field of Search ..... 431/291, 289, 431/288, 126; 362/161, 163; 220/560; D26/9

(56) References Cited

U.S. PATENT DOCUMENTS

| | | | | | |
|---|---|---|---|---|---|
| 1,370,432 | A | * | 3/1921 | Gvosdenvoich | 220/560 |
| 2,234,903 | A | * | 3/1941 | Muench | 431/126 |
| 2,330,705 | A | * | 9/1943 | Hamblet | 431/291 |
| 4,524,408 | A | * | 6/1985 | Minera | 362/163 |
| 4,529,376 | A | * | 7/1985 | Cafolla | 431/125 |
| 4,588,618 | A | * | 5/1986 | Wolfe | 431/125 |
| 4,937,701 | A | * | 6/1990 | Schroder | 362/161 |
| 5,727,709 | A | * | 3/1998 | Nobile | 220/560 |
| 6,092,772 | A | * | 7/2000 | Garcia et al. | 248/205.5 |

FOREIGN PATENT DOCUMENTS

| | | | | |
|---|---|---|---|---|
| DE | 0 27 08 266 A | * | 8/1978 | C11C/5/00 |
| DE | 199 09 802 A | * | 9/2000 | F21V/35/00 |
| GB | 2 272 968 A | * | 6/1994 | F23D/3/16 |
| JP | 11-279588 A | * | 10/1999 | C11C/5/00 |

* cited by examiner

*Primary Examiner*—Henry Bennett
*Assistant Examiner*—Josiah Cocks
(74) *Attorney, Agent, or Firm*—Luis N. Ortiz

(57) ABSTRACT

A floating candle holder is provided that includes: an anchor portion formed of a material having a density greater than that of water; a candle having a wick, the candle positioned above the anchor portion; and a shield portion having an opening defined in the top thereof for changing the candle, the shield portion positioned above the anchor portion, about the candle, and extending above the top of the wick of the candle by an amount that is at least 0.7 times as high as the largest horizontal internal dimension of the opening defined in the top of the shield portion. The anchor portion and shield portion are adapted to float the candle on water. The water line of the floating candle holder is within the bottom two-thirds of the overall height of the floating candle holder, and the center of gravity is below the water line, whereby the location of the center of gravity below the water line helps stabilize the floating candle holder against being capsized by winds. The shield portion protects the flame of the lit candle from the water and wind. At least a portion of the shield portion that is above the water line is at least partially transparent to candlelight. Thus, a floating candle holder is provided that better protects the flame of the candle from the wind, enabling the floating candle holder to be used outdoors.

11 Claims, 1 Drawing Sheet

FLOATING CANDLE HOLDER

BACKGROUND OF THE INVENTION

This invention relates to floating candle holders. The inventor has observed that current commercially-available floating candles do not adequately protect the flame of the candle from ordinary breezes and wind, which prevents the satisfactory use of the floating candle outdoors in ponds or swimming pools.

SUMMARY OF THE INVENTION

In general, a floating candle holder is provided that includes: an anchor portion formed of a material having a density greater than that of water; a candle having a wick, the candle positioned above the anchor portion; and a shield portion having an opening defined in the top thereof for changing the candle, the shield portion positioned above the anchor portion, about the candle, and extending above the top of the wick of the candle by an amount that is at least 0.7 times as high as the largest horizontal internal dimension of the opining defined in the top of the shield portion. The anchor portion and shield portion are adapted to float the candle on water. The water line of the floating candle holder is within the bottom two-thirds of the overall height of the floating candle holder, and the center of gravity is below the water line, whereby the location of the center of gravity below the water line helps stabilize the floating candle holder against being capsized by winds. The shield portion protects the flame of the lit candle from the water and wind. At least a portion of the shield portion that is above the water line is at least partially transparent to candlelight.

Thus, a floating candle holder is provided that better protects the flame of the candle from the wind, enabling the floating candle holder to be used outdoors. These and other aspects and advantages of the invention will become apparent to persons skilled in the art from the following drawings and detailed description of presently most-preferred embodiments of the invention.

BRIEF DESCRIPTION OF THE SEVERAL VIEWS OF THE DRAWING

The accompanying views of the drawing are incorporated into and form a part of the specification to illustrate several aspects and examples of the present invention, wherein like reference numbers refer to like parts throughout the figures of the drawing. These figures together with the description serve to explain the principals of the invention. The figures are only for the purpose of illustrating preferred and alternative examples of how the various aspects of the invention can be made and used and are not to be construed as limiting the invention to only the illustrated and described examples. The various advantages and features of the various aspects of the present invention will be apparent from a consideration of the drawings in which.

DETAILED DESCRIPTION OF PREFERRED EMBODIMENTS OF THE INVENTION

Figure 1:
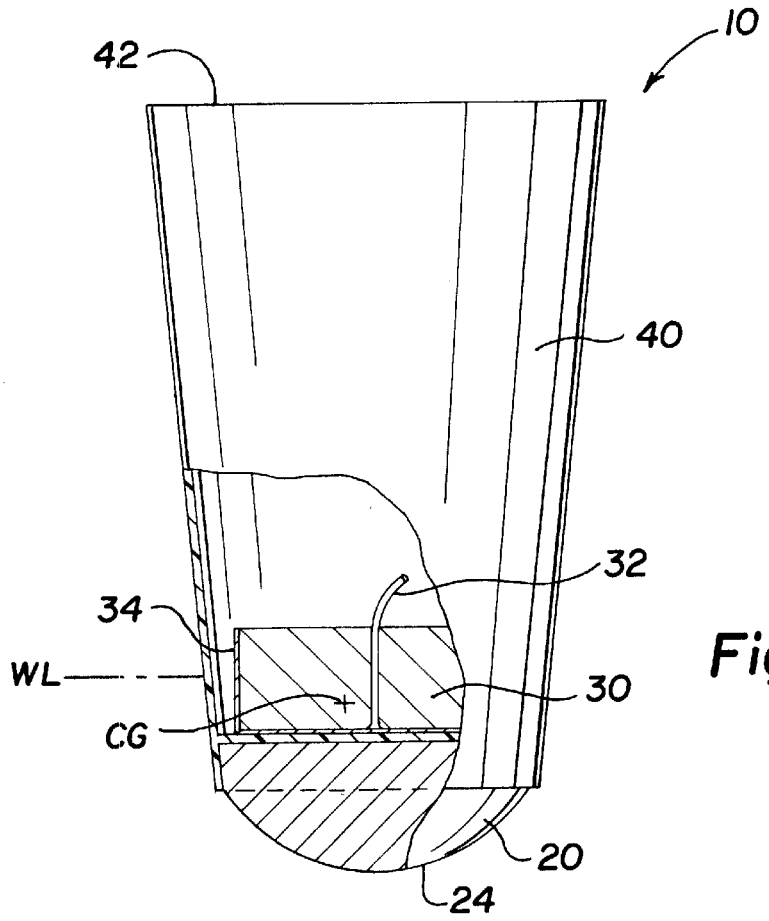
FIG. 1 is a side view with a partial cross-sectional view of a presently most-preferred embodiment of a floating candle holder according to the invention.
Figure 2:
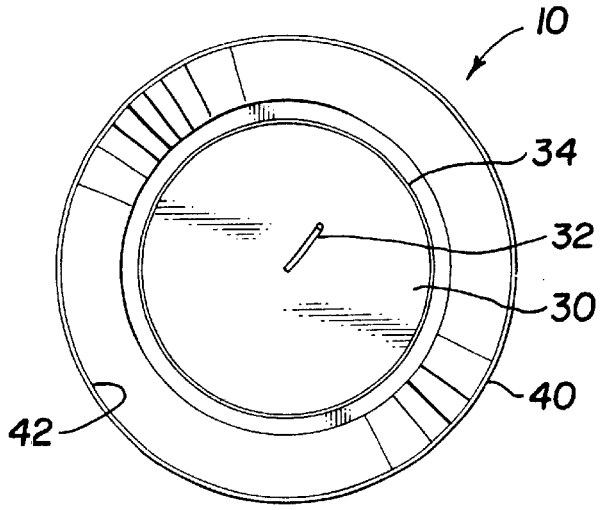
FIG. 2 is a top plan view of the floating candle holder illustrated in FIG. 1.

The present invention will be illustrated by reference to the presently most-preferred embodiment and best mode for practicing the invention. Referring to FIGS. 1 AND 2 of the drawing, in general, a floating candle holder 10 is provided that includes: (a) an anchor portion 20 formed of a material having a density greater than that of water; (b) a candle 30 having a wick 32, the candle 30 positioned above the anchor portion; and (c) a shield portion 40 having an opening 42 defined in the top thereof for changing the candle 30, the shield portion 40 positioned above the anchor portion 20, about the candle 30, and extending above the top of the wick 32 of the candle 30 by an amount that is at least 0.7 times as high as the largest horizontal internal dimension of the opening 42 defined in the top of the shield portion 40. Most preferably, the shield portion 40 has a density less than that of water.

The candle 30 can be any conventional candle of practically any shape having a wick 32. The candle can optionally be positioned in a conventional tray 34. The candle 30 illustrated in FIGS. 1–2 is a common cylindrical candle. The anchor portion 20 and shield portion 40 are adapted to float the candle 30 on water (not shown).

The water line WL of the floating candle holder 10 is within the bottom two-thirds of the overall height of the floating candle holder 10. The center of gravity CG of the floating candle holder 10 is below the water line WL, whereby the location of the center of gravity CG below the water line helps stabilize the floating candle holder 10 against being capsized by winds acting on the shield portion 40. The shield portion 40 protects the flame of the lit candle 30 from the water and wind. At least a portion of the shield portion 40 that is above the water line WL is at least partially transparent to candlelight.

For example, for a cylindrical candle 30, a shield portion 40 having a lower overall diameter of about 3 inches and an opening 42 defined in the top thereof having an internal diameter of about 3.5 inches, the shield portion 40 extends above the top of the wick 32 of the candle 30 by at least about 2.5 inches. More preferably, the shield portion 40 extends above the top of the wick 32 of the candle 30 by an amount that is at least as high as the largest horizontal internal dimension of the shield portion that extends above the top of the candle 30. Thus, according to the presently most-preferred example, the overall height of the floating candle holder is about 6 inches. Although not intending to be bound by any particular theory, it is believed that the larger the opening 42, which allows some of any passing wind into the shield portion 40, the higher the shield portion should extend above the top of the wick 32 of the candle 30 in order to protect the flame.

Although the illustrated embodiment is generally cylindrical in shape with a circular opening 42 defined in the top of the shield portion 40, it is to be understood, of course, that the shield portion 40 could be in the shape of a polygon, a rectangle, a square, or other shape, and that the opening 42 defined in the top can have any such shape that is the same or different as the overall shape of the shield portion 40.

More preferably, the water line WL of the floating candle holder 10 is within about the bottom half of the overall height of the floating candle holder 10. Most preferably, the water line WL of the floating candle holder 10 is within the bottom third of the overall height of the floating candle holder 10 Furthermore, most preferably the center of gravity is within the bottom quarter of the overall height of the floating candle holder 10.

The floating candle holder 10 is preferably adapted to be stable against being capsized by winds up to about 5 miles per hour. More preferably, the floating candle holder 10 is adapted to be stable against being capsized by winds up to about 10 miles per hour. Most preferably, the floating candle holder 10 is adapted to be stable against being capsized by winds up to about 15 miles per hour.

Continuing to refer to FIG. 1, the anchor portion 20 preferably defines a substantially rounded bottom surface 24. A rim included near the container's base can extend below the container's base: to form a cavity suitable for receiving anchor portion material. The anchor portion can therefore be integrated within and substantially surrounded by the rim beneath the container's base, wherein as shown in FIG. 1 the anchor portion and the rim can define a substantially rounded bottom. It is to be understood, of course, that the bottom surface of the anchor portion could be flat, which would also facilitate standing the floating candle holder 10 on a table top or other flat surface (not shown).

The anchor portion 20 can be made of any suitable material having a sufficiently high density, such as metal material, such as stainless steel; a rock material, such as a polished stone or cement aggregate; or glass.

According to the presently most-preferred embodiment of the invention, the shield portion. 40 extends substantially vertically above the top of the wick 32 of the candle 30. Thus, the floating candle holder 10 is most preferably substantially cylindrical in shape, or within a few degrees of being cylindrical, as illustrated in FIGS. 1–2 of the drawing.

The shield portion 40 is most preferably made of a plastic material, which has a relatively low density, has good weathering properties, and can be transparent.

The transparency of the shield portion 40 can be obtained in any number of convenient ways. For example, if the shield is a plastic material, the plastic can be substantially transparent to the candlelight. Of course, the shield portion 40 can also be frosted or colored according to aesthetic desires. In another embodiment, as can be readily appreciated, the shield portion 40 can be formed of a substantially opaque material, but has a plurality of small openings presenting a graphical pattern or image illuminated by the flame of the candle (not shown).

Preferably, the shield portion 40 is glued to the anchor portion 20, but it could be mechanically attached, for example, by snapping interlocking features of the two portion 20 and 40 together or by an interference fit.

As shown in FIG. 1, a rounded bottom portion 24 of the candle holder 10 operates as the anchor portion 20. The shield 40 and rounded bottom portion 24 can be formed of an integrated housing made from, for example, plastic as discussed above. The rounded portion 24 of the candle holder 10 is shown with a cut-away portion thereby revealing anchor material (shaded area) contained within the rounded bottom portion 24 of the candle holder 10. Gravity normally acting on the anchor portion 20 is "interfered" with by an inner surface (not shown) of the bottom portion 24 as previously mentioned with respect to "interference fit" and as further shown in FIG. 1. In accordance with the preferred embodiment of the present invention, the anchor material is resting against the rounded bottom portion 24, and together with the rounded bottom portion 24 make up the anchor portion 20. In should be clear to those skilled in the art from the illustration of FIG. 1 that the inner surface of rounded bottom portion 24 is opposite the outer surface of the rounded bottom portion 24 as shown, and thereby operates to support the anchor material by interference fit. As can be seen in FIG. 1, the anchor 20 is shown "fitted" to the rounded bottom portion 24.

SCOPE OF THE INVENTION NOT LIMITED TO PREFERRED EMBODIMENTS

The invention is described with respect to presently preferred embodiments, but is not intended to be limited to the described embodiments. It will be readily apparent to those of ordinary skill in the art that numerous modifications may be made to the invention without departing from the scope and spirit of the invention.

Having described the invention, what is claimed is:

1. A floating candle holder, comprising:

a container including a shield portion and a base, said shield portion extending upward to an area defining the top of said container, said shield portion having an opening defined in the top thereof for accepting a replaceable candle into the container and including a rim near the container's base, said rim extending below the container's base to allow a cavity for receiving an anchor portion, said anchor portion integrated within and substantially surrounded by the rim of the container beneath the base, wherein the anchor portion and the rim define a substantially rounded bottom;

wherein the combination of the container and the anchor portion provide said floating candle holder within which a replaceable candle contained therein can float on water, wherein water can remain at a level within the bottom two-thirds of the overall height of the floating candle holder, the center of gravity of the floating candle holder is below the water line near the anchor portion wherein the location of the center of gravity below the water line helps stabilize the floating candle holder against being capsized by winds, and wherein by extending the shield portion above any replaceable candle containable therein, the shield portion can protect a lit candle from water and wind, wherein the shield portion is at least partially transparent.

2. The floating candle holder according to claim 1, further comprising a replaceable candle contained within the container, wherein the shield portion extends above the top of the replaceable candle by an amount that is at least as high as the largest horizontal internal dimension of the opening defined in the top of the shield portion.

3. The floating candle holder according to claim 1, wherein the water line of the floating candle holder is within about the bottom half of the overall height of the floating candle holder.

4. The floating candle holder according to claim 1, wherein the water line of the floating candle holder is within the bottom third of the overall height of the floating candle holder.

5. The floating candle holder according to claim 1, wherein the center of gravity is within the bottom quarter of the overall height of the floating candle holder.

6. The floating candle holder according to claim 1, wherein the floating candle holder is adaptable for use on dry surfaces.

7. The floating candle holder according to claim 6, wherein the floating candle holder is stable against being tipped over by winds up to about 10 miles per hour.

8. The floating candle holder according to claim 1, wherein the floating candle holder is stable against being capsized by winds up to about 15 miles per hour.

9. The floating candle holder according to claim 1, wherein the anchor portion is created by at least one of a metal, rock, and glass material.

10. The floating candle holder according to claim 9, wherein the floating candle holder is stable against being capsized by winds up to about 15 miles per hour.

11. The floating candle holder according to claim 9, wherein the floating candle holder is adaptable for use on dry surfaces and is stable against being tipped over by winds up to about 10 miles per hour.

* * * * *